United States Patent [19]

Koppelman

[11] Patent Number: 5,071,447

[45] Date of Patent: Dec. 10, 1991

[54] APPARATUS AND PROCESS FOR STEAM TREATING CARBONACEOUS MATERIAL

[75] Inventor: Edward Koppelman, Encino, Calif.

[73] Assignee: K-Fuel Partnership, Denver, Colo.

[21] Appl. No.: 429,795

[22] Filed: Oct. 31, 1989

[51] Int. Cl.[5] ..... C10L 9/00; C10L 9/08

[52] U.S. Cl. ..... 44/621; 44/620

[58] Field of Search ..... 44/620, 621

[56] References Cited

U.S. PATENT DOCUMENTS

| | | | |
|---|---|---|---|
| 3,909,212 | 9/1975 | Schroeder | 44/1 R |
| 4,047,898 | 9/1977 | Cole et al. | 44/1 G |
| 4,052,168 | 10/1977 | Koppelman | 44/1 G |
| 4,052,293 | 10/1977 | Mercer et al. | 44/620 |
| 4,144,033 | 3/1979 | Nakako et al. | 44/620 |
| 4,192,650 | 3/1980 | Seitzer | 44/1 R |
| 4,471,536 | 9/1984 | Herber et al. | 34/60 |
| 4,472,885 | 9/1984 | Nakabayaski et al. | 34/9 |
| 4,477,257 | 10/1984 | Koppelman et al. | 44/30 |
| 4,514,912 | 5/1985 | Janusch et al. | 34/37 |
| 4,523,927 | 6/1985 | Kuge et al. | 44/620 |
| 4,601,113 | 7/1986 | Draper et al. | 34/10 |
| 4,628,619 | 12/1986 | Janusch et al. | 34/180 |
| 4,667,416 | 5/1987 | Hacker et al. | 34/9 |
| 4,741,837 | 5/1988 | Schweitzer et al. | 210/665 |
| 4,810,258 | 3/1989 | Greene | 44/33 |

*Primary Examiner*—Prince E. Willis
*Assistant Examiner*—E. McAvoy
*Attorney, Agent, or Firm*—Harness, Dickey & Pierce

[57] ABSTRACT

An apparatus and process of steam treating carbonaceous materials under a controlled temperature and pressure. The feed material is introduced into an autoclave or similar vessel and injected with steam at a high pressure and temperature for a controlled period of time to effect thermal restructuring of the carbonaceous material and to effect a conversion of the moisture and a portion of the volatile organic constituents therein to a gaseous phase. Water, wax and tar are recovered during this process and the water may be used as a source of pre-heating feed material in another vessel while the tar may be used as a heating source since it has a high heating value. The upgraded product is allowed to cool and then removed from the reaction vessel. The invention alternatively contemplates use of a separate pre-heating chamber for the carbonaceous feed material.

20 Claims, 2 Drawing Sheets

APPARATUS AND PROCESS FOR STEAM TREATING CARBONACEOUS MATERIAL

BACKGROUND OF THE INVENTION

The present invention is particularly applicable, but not necessarily restricted, to the processing of carbonaceous materials under high pressures at elevated temperatures, whereby the energy introduced to effect a heating of the feed material and to effect the desired reaction is substantially recovered, providing for improved efficiency and economies in the practice of the process. Typical of processes to which the present invention is applicable is the treating of various naturally occurring organic carbonaceous materials, such as wood or peat, to effect a removal of a predominant portion of moisture therefrom, and the treatment of sub-bituminous coals, such as lignite, to render them more suitable as solid fuel, and the like.

In each of the aforementioned processes, the carbonaceous material is subjected to high pressure steam to reach an elevated temperature while in a controlled environment for a period of time to achieve the desired thermal treatment. A variety of process equipment and processing techniques have heretofore been used or proposed for treating carbonaceous material so as to render it more suitable as a solid fuel. These processes have presented problems in the efficient utilization of energy introduced and/or evolved, the difficulty and complexity of controls necessary in many instances to enable operation of such processes on a continuous basis, and a general lack of flexibility and versatility of such equipment for adaptation for the processing of other materials at different temperatures and/or pressures.

The apparatus and process of the present invention overcomes many of the problems and disadvantages associated wit prior art equipment and techniques by providing a unit which is of simple design, of durable construction, which is versatile in use and can be readily adapted for processing different feed materials under different temperatures and/or pressures to produce different products. The apparatus of the present invention is further characterized as being simple to control and efficient in the utilization and recovery of heat energy, thereby providing for economical operation and a conservation of resources.

SUMMARY OF THE INVENTION

The benefits and advantages of the present invention are achieved by a process and apparatus in which carbonaceous materials in a substantially as-mined condition containing from about 20% up to about 80% moisture are charged into an autoclave and injected with steam at a high pressure and temperature for a controlled period of time to effect a controlled thermal restructuring of the carbonaceous material and to effect a conversion of the moisture and a portion of the volatile organic constituents therein into a gaseous phase. Water, wax and tar are recovered during the autoclaving process. At the conclusion of the autoclaving step, the carbonaceous material is allowed to cool, and then removed from the autoclave.

In an alternative arrangement, carbonaceous material containing from about 20% up to about 80% moisture is charged into a separate pre-heating chamber, wherein the feed material is heated under a relatively low pressure (in the range of from about 200 to about 600 psig, with about 500–550 psig before preferred) to a temperature of from about 400° F. to about 500° F. (465° F.–475° F. preferred). Water which is substantially free of coal tar and other impurities is recovered from the preheating chamber, degassed and returned to the boiler as steam generating feedwater. The preheated feed material is then vented to the atmosphere and transferred to a second autoclave where it is subjected to steam under pressure for a controlled period of time to effect controlled thermal restructuring. Water, wax and tar are recovered during the autoclaveing process, with at least a portion of the water under pressure being filtered and some of its BTU content scavenged via flash pots and recirculated to the preheating chamber to assist in the preheating of a second charge of feed material which has been introduced into the preheating chamber. The wax and tar products which have been recovered from the second autoclave can be utilized as a heat source for the steam generator, thereby forming a self-sustaining steam generating treatment system.

The upgraded product has an internal structure which is visibly transformed from the original carbonaceous material charged and possesses increased heating values of a magnitude generally ranging from about 11,500 up to about 13,500 BTU per pound. In contrast, subbituminous coal, for example, on an as-mined basis has a heating value of about 8,000 BTU per pound, while on a moisture-free basis has a heating value ranging from about 10,300 up to about 11,500 BTU per pound. This same increase in heating value is seen with other carbonaceous materials as well. Further, the tar and wax recovered during the autoclaving operation has a heating value from about 10,700 up to about 11,000 BTU per pound.

BRIEF DESCRIPTION OF THE DRAWING

Additional benefits and advantages of the present invention will become apparent upon the reading of a description of a preferred embodiment taken in conjunction with the specific examples provided and the drawing, in which.

DETAILED DESCRIPTION

The process of the present invention is applicable for upgrading carbonaceous materials including but not limited to, brown coal, lignite, and sub-bituminous coals of the type broadly ranging between wood, peat and bituminous coals which are found in deposits similar to higher grade coals. Such carbonaceous materials as-mined generally contain from about 20% up to about 80% moisture and can be directly employed without any preliminary treatment other than a screening operation as a charge to an autoclave 101 of FIG. 1. It is usually preferred to effect a screening and/or crushing of the carbonaceous material as-mined to remove any large particles which may be attached thereto so as to facilitate a better handling of the charge and improve the packing thereof in the autoclave 101. The size and configuration of the carbonaceous material, however, is not critical in achieving the benefits of the process of the present invention.

Figure 1:
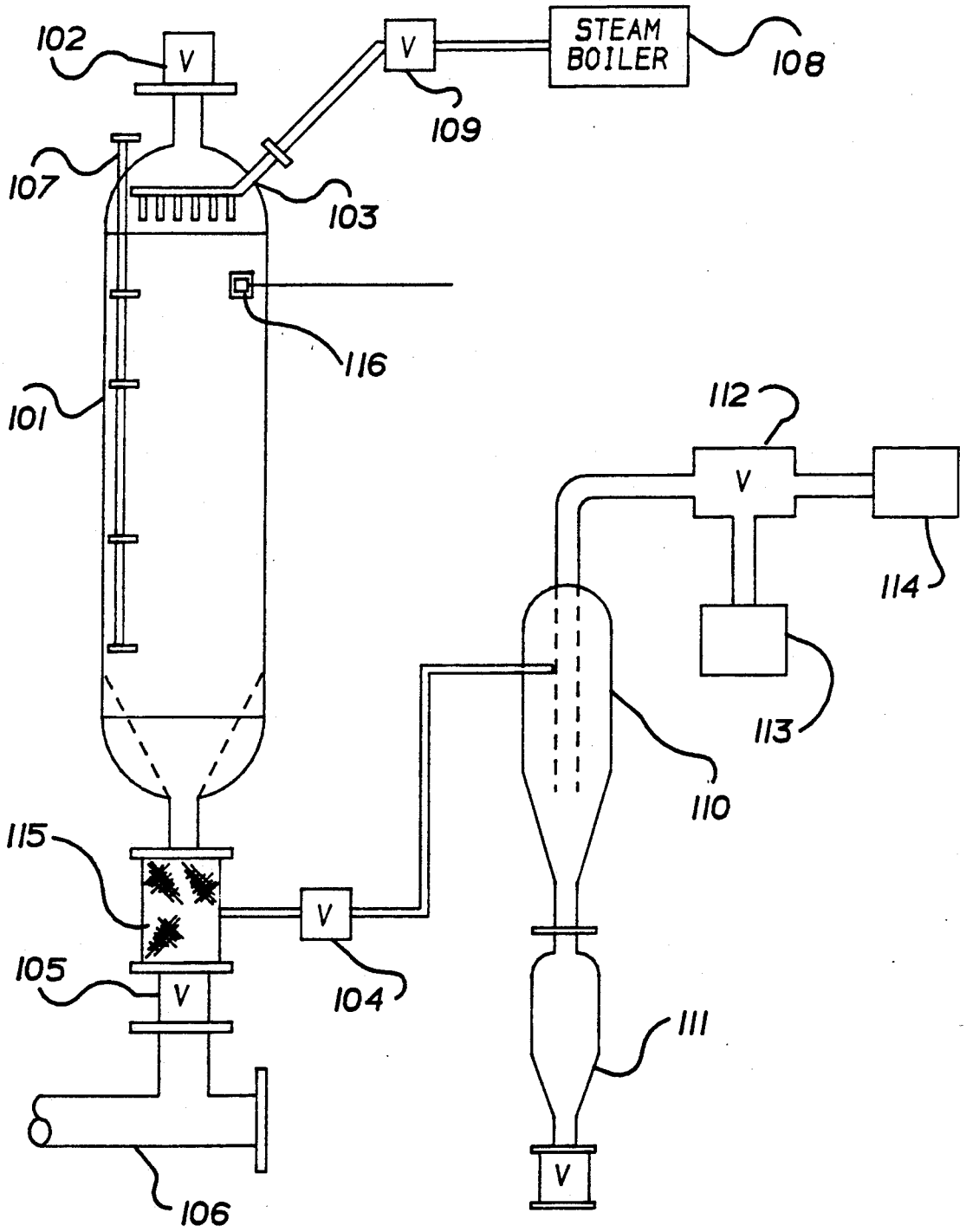
FIG. 1 is a functional schematic of an autoclave-based processing system arranged in accordance with the principles of the present invention.

With reference to FIG. 1, the autoclave 101 employed may comprise any of the types known in the art capable of withstanding the temperatures and pressures required, and while the present description is directed particularly to batch-type autoclaves, it will be understood that continuous autoclaves can also be employed for the practice of the invention. The carbonaceous material is charged to an inlet at one end of the autoclave 101 by opening a valve 102, and high pressure steam from a boiler 108 is then introduced through a valve 109 into an opening 103 in the autoclave 101 at a position in the vicinity of inlet valve 102.

After the high pressure steam is introduced into the autoclave 101, the steam comes into contact with the carbonaceous material in the autoclave and condenses almost immediately. This condensed steam (water) travels downward to the bottom of the autoclave 101 and begins to heat the carbonaceous material as the high pressure steam continues to be introduced into the top of autoclave 101 until a predetermined temperature and pressure are reached throughout the entire volume of antoclave 101. Hence, it is seen that the charge is subjected .to a moving atmosphere of high pressure steam from the top of the charge of feed material to the bottom.

The pressure in the autoclave 101 is monitored by a pressure sensor 116 and is allowed to reach a predetermined level and then a relief valve 104 at the bottom of the autoclave 101 is opened to maintain that pressure. The temperature of the steam inside the autoclave 101 is monitored by a thermocouple array 107 until it reaches a preselected temperature at the bottom relief valve 104. Alternatively, the temperature may be monitored in the autoclave's output conduit rather than inside the autoclave itself. When this steam temperature is reached, the bottom relief valve 104 is closed and the carbonaceous material is allowed to soak for a period of time sufficient to allow a desired degree of thermal restructuring and/or decomposition.

Steam temperatures and pressures can be utilized in a range of from about 520° F. at a pressure of about 800 psig, to about 650° F. at a pressure of about 2400 psig, to obtain a thermal restructuring of the carbonaceous material. However, the best results in treating coal have been obtained when the steam temperature is allowed to reach on the order of 620° F. and the pressure in the autoclave 101 is allowed to reach on the order of 1800 psig.

The residence time of the carbonaceous material charge in the autoclave 101 will vary, depending upon the amount of thermal reconstructuring desired and the heating value that is desired. This residence time will generally range from about 5 to about 15 minutes in length after the bottom relief valve reaches a steam temperature of about 620° F.

The required residence time decreases as the temperature and pressure in the autoclave 101 increase. Conversely, increased residence times are required when lower temperatures and pressures are used.

The pressurization of the interior of the autoclave 101 can be controlled by a relief valve 104 located at the bottom of the autoclave 101. When the pressure inside the autoclave 101 reaches 1800 psig, the relief valve 104 can be opened to maintain that pressure. This pressure of 1800 psig is maintained until the steam reaches the bottom relief valve 104 at a temperature of 620° F. When the steam of valve 104 reaches a temperature of 620° F. the bottom relief valve 104 is closed and the carbonaceous material is allowed to soak with the high pressure steam at 620° F. for a period of time preferably between from about 5 to about 15 minutes. The process time—the time during which the high pressure steam is introduced until the desired temperature and pressure are reached and the bottom relief valve 104 is closed—can range from about 5 minutes to about 60 minutes.

At the conclusion of the autoclaving step, in accordance with one embodiment of the present invention, the autoclave 101 is then vented to the atmosphere or into an adjoining or available holding tank and a valve 105 at the bottom of the autoclave 101 is opened. The carbonaceous material is then extracted through a filter, such as a Johnson screen, 115 from the autoclave 101 via an extruder 106.

It is also contemplated in accordance with the present invention that during the autoclaving operation, water, wax and tar that are formed can be recovered through a pressure relief valve 104 at the bottom of the autoclave 101 and transported to an adjoining conventional separator 110. Once in the separator 110, the tar and wax can be separated from the water, for example, by centrifugal force and transported to an adjoining tank 111 for later use. The water can then be recovered through a valve 112 and transported to an adjoining tank 113 as waste until the water reaches a temperature of about 250° F. When the water temperature reaches 250° F., it is recovered for later use and transported to an adjoining holding tank 114. Alternatively, the hot water at above about 250° F. could be fed to another autoclave for use in preheating the charge of feed material therein.

Figure 2:
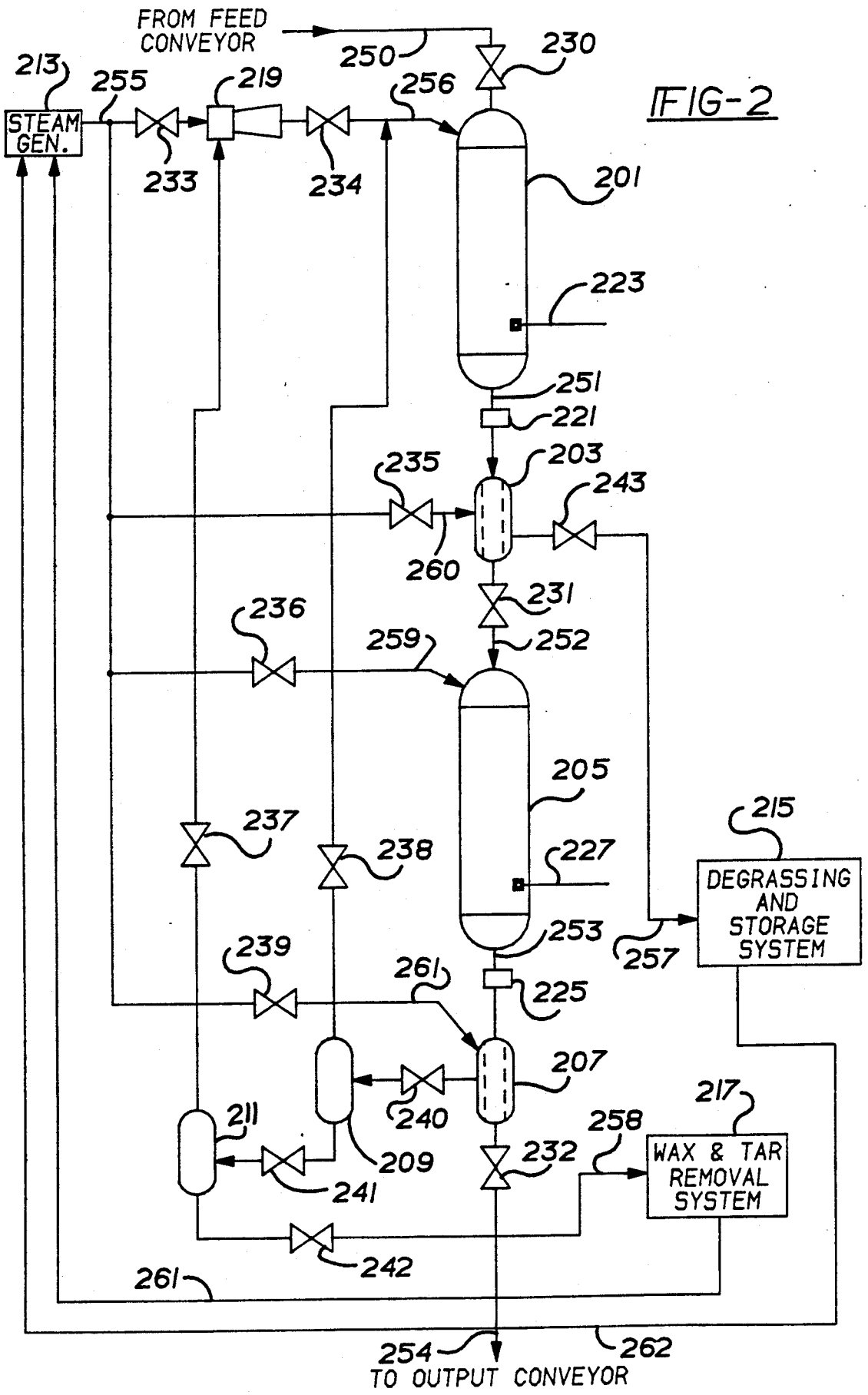
FIG. 2 is a functional schematic of an alternative processing system arranged in accordance with the principles of the invention.

With reference to FIG. 2, a processing system arranged in accordance with the principles of the invention in an alternative form is set forth and features the use of a separate preheating pressurized chamber for the feed material prior to the feed material's introduction into the high pressure autoclave such as autoclave 101 of FIG. 1. As seen from FIG. 2, feed material such as sub-bituminous coal is directed from a feed conveyor at line 250 via high pressure valve 230 into a preheating chamber 201. Output conduit 251 of vessel 201 is coupled to a filter 203 (such as a Johnson screen) and then is passed via high pressure valve 231 to input conduit 252 leading into high pressure autoclave 205.

Material treated in vessel 205 is then fed via output conduit 253 and filter 207 (also for example a Johnson screen) and valve 232 to an output conveyor or extruder via line 254.

Steam generator 213 produces high pressure steam at its output 255 which is directed via valve 233, thermal compressor 219, valve 234 and input conduit 256 to the interior of preheating chamber 201. Additionally, generated steam at output 255 is coupled via valve 235 to an input 260 to filter 203, via valve 236 to input conduit 259 of autoclave 205 and via valve 23 to input conduit 261 to filter 207.

One output of filter 207 is coupled via valve 240 to a primary flash pot 209. One output of flash pot 209 is coupled via valve 238 to input conduit 256 of preheating chamber 201, while a second output of primary flash pot 209 is coupled via valve 241 to an input of a secondary flash pot 211. One output of flash pot 211 is coupled via valve 242 to input 258 to a conventional wax and tar removal system 217, while a second output of flash pot 211 is coupled via valve 237 to thermal compressor 219.

Wax and tar which have been removed from the output water of flash pot 211 via system 217 may then be fed via line 261 to steam generator 213 for use as a heat source in effecting steam generation therein.

An output of filter 203 is coupled via valve 243 to input 257 to a conventional degassing and storage system 215. The water fed to degassing and storage system 215 via filter 203 is then processed and passed in a substantially clean state via line 262 to steam generator 213 for use as feedwater therein.

The internal pressure developed within preheating chamber 201 is monitored via pressure sensor 223, while the temperature of the preheating medium utilized in vessel 201 is monitored by a temperature sensor (such as a thermocouple) 221 which has been placed in the output conduit 251 of vessel 201. In a similar manner, pressure within main processing autoclave 205 is monitored via pressure sensor 227, and the temperature of the heating medium of vessel 205 is monitored via a temperature sensor (such as a thermocouple) 225 which has been positioned in output conduit 253 of vessel 205.

By utilizing a separate preheating chamber 201, the system of FIG. 2 operates the preheating vessel 201 at a relatively low pressure such that water exiting the preheating chamber via filter 203 is clean enough to be reusable in steam generator 213. This greater efficiency may be achieved at no substantial added cost, since the top vessel 201 can be of a cheaper construction due to the use of lower pressures therein.

In using the system of FIG. 2, a charge of feed material is introduced via line 250 and high pressure valve 230 into vessel 201. Valve 230 is then closed and steam at a pressure of on the order of 200 to 600 psig, (preferably about 500–550 psig) is introduced into preheating chamber 201. Condensed water then exits vessel 201 via filter 203 and valve 243 to a degassing and storage system 215 for processing and return to steam generator 213 via line 262 for use in generating further steam requirements of the system.

After preheating the charge in vessel 201 to a predetermined temperature (preferably 465°–475° F.), vessel 201 is vented to the atmosphere and mid-lock valve 231 is opened thereby emptying the feed charge into main autoclave 205 under atmospheric pressure.

Valve 231 is then closed and a new feed charge can at that time be fed into preheating vessel 201 via line 250 and valve 230. Simultaneously, high pressure steam (1800 psig preferred) is introduced into main autoclave 205 via valve 236 for contact with the preheated feed material which has been introduced from the upper preheating chamber 201.

Condensed hot water exits the autoclave at output 253 after the vessel 205 reaches preferably 1800 psig and is directed from filter 207 to a primary flash tank 209 via valve 240. Due to the pressure drop experienced by the water entering flash tank 209, steam with its accompanying BTU value is scavenged back to preheating vessel 201 via valve 238 and input conduit 256 to assist in preheating the subsequently fed charge introduced into vessel 201.

Then the balance of the water from primary flash pot 209 is directed to a secondary flash pot 211 where additional steam is scalped due to yet a further pressure drop experienced by creating a vacuum at thermal compressor 219. This additional steam is likewise fed via valve 237 and compressor 219 and valve 234 and input conduit 256 into preheating vessel 201 to further assist in the preheating process.

The water and tar and wax mixture remaining in flash pot 211 is then directed via valve 242 to input 258 of conventional wax and tar removal system 217. In system 217, water is separated from the wax and tar by conventional methods and the wax and tar may then be passed via line 261 to steam generator 213 for use as fuel for boiling the feed water to generate the steam required by the arrangement of FIG. 2.

When the water exiting autoclave 205 changes to steam at the preselected temperature and pressure, valves 232 and 240 are closed and the feed material is allowed to soak with the high pressure steam at the predetermined temperature for a predetermined period of time (preferably 5–15 minutes) in a manner similar to the approach described with reference to the autoclave 101 of FIG. 1.

In order to further illustrate the present invention, the following specific examples are provided. It will be understood that these examples are provided as being illustrative of usable variations in the time, temperature and pressure relationships employed in the invention and are not intended to limit the scope of the invention as herein described and as set forth in the sub-joining claims.

EXAMPLE 1

Coal having an as-mined moisture content of 30% by weight and a heating value of about 8100 BTU per pound was charged into an autoclave. High pressure steam was then introduced into the autoclave for a period of 15 minutes while the pressure inside the autoclave was maintained at 1800 psig and the temperature of the steam inside the autoclave was allowed to reach 620° F. The autoclave was then closed off and the coal was allowed to soak at a pressure of 1800 psig at a temperature of 620° F. for a period of 15 minutes. At the completion of the autoclaving operation, a valve at the bottom of the autoclave was opened and the charge was removed. The upgraded coal product had a moisture content of 0.04% by weight and had a measured heating value of 12475 BTU per pound.

EXAMPLE 2

Coal having an as-mined moisture content of 30% by weight and a heating value of about 8100 BTU per pound was charged into an autoclave. High pressure steam was then introduced into the autoclave for a period of 16 minutes while the pressure inside the autoclave was maintained at 1600 psig and the temperature of the steam inside the autoclave was allowed to reach 600° F. The autoclave was then closed off and the coal was allowed to soak at a pressure of 1600 psig and a steam temperature of 600° F. for a period of 20 minutes. At the completion of the autoclaving operation, a valve at the bottom of the autoclave was opened and the charge was removed. The upgraded coal product had a moisture content of 3.17% by weight and had a measured heating value of 12149 BTU per pound.

EXAMPLE 3

Coal having an as-mined moisture content of 30% by weight and a heating value of about 8100 BTU per pound was charged into an autoclave. High pressure steam was then introduced into the autoclave for a period of 15 minutes while the pressure inside the autoclave was maintained at 1150 psig and the temperature of the steam inside the autoclave was allowed to reach 560° F. The autoclave was then closed off and the coal was allowed to soak at a pressure of 1150 psig and a steam temperature of 560° F. for a period of 10 minutes.

At the conclusion of the autoclaving operation, the charge was removed from the autoclave. The upgraded coal product had a moisture content of 3.9% by weight and a measured heating valve of 11631 BTU per pound.

EXAMPLE 4

Coal having an as-mined moisture content of 30% by weight and a heating value of 8100 BTU per pound was charged into an autoclave. High pressure steam was then introduced into the autoclave for a period of 15 minutes while the pressure inside the autoclave was maintained at 1800 psig and the temperature of the steam inside the autoclave as allowed to reach 620° F. During this autoclaving operation, tar was recovered through a valve and transported to a separator along with the water that was forming as condensed steam. The tar was then separated from the water and the tar had a measured heating value of 10824 BTU per pound.

EXAMPLE 5

Coal having an as-mined moisture content of approximatey 30% by weight and a heating value of 8000 BTU per pound was charged into a preheating chamber. Steam at 500 psig was fed into the preheating chamber until steam exiting the bottom of the preheating chamber reached a temperature of approximately 465° F. The preheating chamber was vented to the atmosphere and the charge was then placed in a main processing autoclave, and steam at 1800 psig was introduced therein. When the temperature of the steam at the bottom of the main processing autoclave reached 620° F., the autoclave was closed off and the coal charge was allowed to soak for a period of 10–15 minutes. At the completion of the autoclaving operation the autoclave was vented to atmosphere and the coal charge removed. The upgraded coal product had a moisture content of 0.4–2.0% by weight and a measured heating value of approximately 12,300 BTU per pound.

While it will be apparent that the preferred embodiments of the invention disclosed are well calculated to fulfill the objects above stated, it will be appreciated that the invention is susceptible to modification, variation and change without departing from the spirit thereof.

What is claimed is:

1. A method of steam treating carbonaceous material comprising the steps of:

a. introducing carbonaceous material to a vessel, b. injecting high pressure steam into the vessel until the inside of the vessel reaches a pressure of between about 1600 psig and about 1800 psig, c. maintaining the pressure in the vessel, d. sensing the temperature of the steam and water driven from the carbonaceous material and condensed steam in the vessel, e. removing the water and condensed steam, f. closing a bottom valve on the vessel when the steam reaches a temperature of between about 600° F. to about 620° F. and allowing the carbonaceous material to soak in uncondensed steam for a time period sufficient to effect further thermal restructuring of the carbonaceous material, and g. thereafter recovering the carbonaceous material.

2. A process of steam treating carbonaceous material which comprises the steps of charging carbonaceous material into an autoclave, introducing high pressure steam into a first end of the autoclave and allowing the steam to migrate along a charge of carbonaceous material toward a second end of the autoclave until the pressure reaches at least about 800 psig up to about 2400 psig and the temperature of the steam exiting the second end of the autoclave is at least about 520° F. up to about 650° F., expelling water driven from the charge and condensing from the introduced steam, sealing off the first and second ends of the autoclave such that the charge will soak in uncondensed steam for a period of time sufficient to convert moisture and some volatile organic constituents in the charge into a gaseous phase and to effect a partial restructuring of the chemical structure thereof and a change in its chemical composition, and thereafter cooling the carbonaceous material charge and recovering the upgraded product.

3. The process as defined in claim 2 where the temperature of the steam is at least about 600° F. up to about 620° F.

4. The process as defined in claim 3 wherein the process is carried out at a pressure of at least about 1700 psig up to about 1800 psig.

5. The process as defined in claim 2 wherein the process is carried out at a pressure of at least about 2300 psig up to about 2400 psig.

6. The process as defined in claim 4 wherein the carbonaceous material is subjected to uncondensed steam at the temperature and pressure for a period of time of at least about 5 minutes.

7. The process as defined in claim 4 wherein the carbonaceous material is subjected to uncondensed steam at the temperature and pressure for a period of time of at least about 15 minutes.

8. A process of steam treating carbonaceous material which comprises the steps of opening an upper valve and charging carbonaceous material into an autoclave, introducing high pressure steam into a top portion of the autoclave until the pressure reaches a level between about 800 psig and about 2400 psig, opening a relief valve at a bottom portion of the autoclave to maintain the pressure, removing water driven from the carbonaceous material and condensed steam and transporting said water to an adjoining tank, allowing the steam to reach a temperature between about 520° F. and about 650° F. at the relief valve at the bottom of the autoclave, closing the bottom relief valve when the steam reaches the temperature and allowing the carbonaceous material to soak in uncondensed steam for a time sufficient to effect thermal restructuring of the carbonaceous material, venting the tank to the atmosphere, and recovering the upgraded carbonaceous material.

9. The process of claim 8 wherein the steam pressure is about 1800 psig and the steam temperature is about 620° F.

10. The process of claim 9 wherein the time is in the range of from about 5 minutes up to about 15 minutes.

11. The process of claim 8 wherein the upgraded carbonaceous material is recovered via an extruder for pelletizing the upgraded carbonaceous material.

12. The process of claim 8 comprising a further step of removing tar formed during the autoclaving process along with the water formed as condensed steam and transporting said water and tar to a separator means where the tar and water can be recovered.

13. The process of claim 8 wherein the time is in the range of from about 15 minutes up to about 20 minutes.

14. A method for steam treating carbonaceous material comprising:

placing the carbonaceous material into a preheating chamber;

introducing steam at a first pressure between about 200 psig and about 600 psig into the preheating chamber;

monitoring temperature of condensed water exiting the preheating chamber;

cutting off the steam introduced and venting the preheating chamber to atmosphere when steam exiting the preheating chamber reaches a first temperature between about 400° F. and about 500° F.;

emptying preheated carbonaceous material from the preheating chamber into a main processing chamber;

introducing steam at a second pressure between about 800 psig and about 2400 psig into the main processing chamber;

monitoring temperature of steam and water condensed therefrom exiting the main processing chamber;

closing off the main processing chamber for a time period sufficient to effect thermal restructuring of the carbonaceous material in the presence of uncondensed steam at the second pressure when the steam exiting the main processing chamber reaches a second temperature between about 520° F. and about 650° F.; and emptying the treated carbonaceous material from the main processing chamber into output means upon the completion of the time period.

15. The method of claim 14 wherein the first temperature is in a range of from about 465° F. to about 475° F., while the first pressure is in a range from about 500 psig up to about 500 psig.

16. The method of claim 14 wherein the second temperature is about 620° F. and the second pressure is abut 1800 psig.

17. The method of claim 14 wherein the time period is in the range of from about 5 minutes up to about 15 minutes.

18. The method of claim 14 including the further step of conducting water exiting the preheating chamber back to a steam generator for use as feedwater therein.

19. The method of claim 14 including the further steps of introducing water exiting the main processing vessel into flash pot means at reduced pressure to flash off further steam from the water and sending the steam back to the preheating chamber for use therein.

20. The method of claim 14 including the further steps of separating wax and tar from water exiting the main processing chamber and sending the wax and tar to a steam generator for use as fuel therewith.

* * * * *

UNITED STATES PATENT AND TRADEMARK OFFICE

CERTIFICATE OF CORRECTION

PATENT NO. : 5,071,447

DATED : December 10, 1991

INVENTOR(S) : Edward Koppelman

It is certified that error appears in the above-identified patent and that said Letters Patent is hereby corrected as shown below:

Column 1, Line 38, Cancel "wit" and insert --with--.

Column 2, Line 1, Cancel "before" and insert --being--.

Column 4, Line 56, Cancel "23" (after "valve") and insert --239--.

Column 6, Line 38, Cancel "0.04%" and insert --4.0%--.

Column 7, Line 4, Cancel "valve" and insert --value--.

Column 7, Line 13, Cancel "as" and insert --was--.

Column 10, Line 7, Claim 15, Cancel "500 psig" and insert --550 psig--. (2nd occ)

Column 10, Line 9, Claim 16, Before "1800" cancel "abut" and insert --about--.

Signed and Sealed this

Sixth Day of July, 1993

*Attest:*

Michael K. Kirk

MICHAEL K. KIRK

*Attesting Officer*

*Acting Commissioner of Patents and Trademarks*